US005967363A

United States Patent [19]

Allen

[11] Patent Number: 5,967,363

[45] Date of Patent: Oct. 19, 1999

[54] PAINT CAN SYSTEM

[76] Inventor: Shardon C. Allen, 5222 Woodlane, Clarkston, Mich. 48348

[21] Appl. No.: 09/130,126

[22] Filed: Aug. 6, 1998

[51] Int. Cl.[6] ..... B65D 25/00; B65D 41/02; B65D 53/02

[52] U.S. Cl. ..... 220/806; 220/701; 220/733; 220/798; 220/804

[58] Field of Search ..... 220/806, 570, 220/796, 797, 798, 801, 802, 803, 804, 378, 695, 698, 699, 700, 701, 733, 287, 256; 215/319

[56] References Cited

U.S. PATENT DOCUMENTS

| | | | |
|---|---|---|---|
| 1,696,240 | 12/1928 | Kircher, Jr. . | |
| 2,207,210 | 7/1940 | Von Knauf . | |
| 2,812,886 | 11/1957 | Weinstein . | |
| 2,885,108 | 5/1959 | Donoghue . | |
| 3,727,792 | 4/1973 | Levin . | |
| 3,945,527 | 3/1976 | Pylant . | |
| 4,352,438 | 10/1982 | Carino . | |
| 4,969,570 | 11/1990 | Harvey, Sr. . | |
| 5,012,960 | 5/1991 | Arnold . | |
| 5,123,565 | 6/1992 | Majewski . | |
| 5,125,530 | 6/1992 | Straub | 220/784 |
| 5,160,067 | 11/1992 | Luber . | |
| 5,172,822 | 12/1992 | DeFrance . | |
| 5,193,705 | 3/1993 | McCallum et al. | 220/798 |
| 5,261,551 | 11/1993 | Watt | 220/798 |
| 5,568,879 | 10/1996 | Kovathana | 220/700 |
| 5,779,093 | 7/1998 | Pooles et al. | 220/700 |

*Primary Examiner*—Stephen Castellano
*Assistant Examiner*—Niki M. Eloshway
*Attorney, Agent, or Firm*—Joseph N. Breaux

[57] ABSTRACT

A paint can system including a paint can, a lid and a sealing ring having a sealing ridge that is insertable into the lid ridge receiving channel of the rim assembly of the paint can. The sealing ring includes a brush wiping flange that has an outer flange edge that defines an opening through which the paint brush can be loaded with paint when the sealing flange is installed. The sealing ring is adapted such that the lid of the paint can is seatable, in an upside down orientation, onto the sealing ring to cover the opening through the sealing ring to seal the paint can.

1 Claim, 4 Drawing Sheets

PAINT CAN SYSTEM

TECHNICAL FIELD

The present invention relates to paint packaging systems and more particularly to a paint can system including a paint can having a paint can rim assembly to which a user can affix a lid or a resilient sealing ring having a brush wiping flange defining a central sealing ring opening through which a paint brush can be loaded; the paint can including a cylinder shaped paint holding cavity and a paint can rim assembly; the paint can rim assembly including a circumferential lid/first sealing ring ridge receiving channel defined therein of a first channel bottom width and a circumferential inner rim edge that defines a circular top opening in connection with the paint holding cavity; the lid having a circumferential lid edge, a circumferential lid ridge, a circumferential first sealing ring ridge receiving channel, a circumferential inner rim edge receiving channel, and a circular central lid portion; the circumferential lid ridge being formed adjacent to the circumferential lid edge and of a first ridge tip width; the circumferential first sealing ring ridge receiving channel being formed in alignment with the circumferential lid ridge and of a second channel bottom width; the circumferential inner rim edge receiving channel being in opposite orientation to the first sealing ring ridge receiving channel and of a third channel bottom width; the sealing ring being molded of a resilient material and including a circumferential outer edge portion, a circumferential lid edge receiving channel formed into the outer edge portion, a circumferential first sealing ring ridge partially defining the lid edge receiving channel and having a second ridge tip width, a circumferential second sealing ring ridge oriented oppositely away from the first sealing ring ridge and having a third ridge tip width, a brush wiping flange integrally formed with the first and the second ring sealing ridges and having an outer flange edge; and a central sealing ring opening defined by the outer flange edge of the brush wiping flange; the first channel bottom width, the first ridge tip width, and the third ridge tip width being equal; the second channel bottom width and the second ridge tip width being equal; the lid edge receiving channel being sized to receive the lid edge therein when the circumferential first sealing ring ridge is inserted into the circumferential first sealing ring ridge receiving channel.

BACKGROUND ART

Paint often accumulates in the lid ridge receiving channel of the rim assembly of opened paint cans. This paint accumulation can cause a mess when the lid is reseated. It would be a benefit, therefore, to have a paint can system that included a sealing ring having a sealing ridge that was insertable into the lid ridge receiving channel of the paint can rim assembly after the lid is removed to fill the lid ridge receiving channel and thereby prevent paint from accumulating in the lid ridge receiving channel. Because it is desirable to adjust the paint loading of a paint brush by scraping the side of the paint brush against an edge, it would be a further benefit to have a paint can system that included a sealing ring as describe that further included a brush wiping flange that had an outer flange edge that defined an opening through which the paint brush could be loaded when the sealing flange was installed. Because it may be desirable in some instances to seal the paint can for a short period of time, such as a lunch or coffee break, it would be a further benefit if the lid of the paint can could be seated, in an upside down orientation, onto the sealing ring to cover the opening through the sealing ring to seal the paint can.

GENERAL SUMMARY DISCUSSION OF INVENTION

It is thus an object of the invention to provide a paint can system that includes a sealing ring having a sealing ridge that is insertable into the lid ridge receiving channel of a paint can rim assembly.

It is a further object of the invention to provide a paint can system that includes a sealing ring having a brush wiping flange that had an outer flange edge that defines an opening through which the paint brush can be loaded with paint when the sealing flange is installed.

It is a further object of the invention to provide a paint can system that includes a sealing ring adapted such that the lid of the paint can is seatable, in an upside down orientation, onto the sealing ring to cover the opening through the sealing ring to seal the paint can.

It is a still further object of the invention to provide a paint can system that includes a paint can having a paint can rim assembly to which a user can affix a lid or a resilient sealing ring having a brush wiping flange defining a central sealing ring opening through which a paint brush can be loaded; the paint can including a cylinder shaped paint holding cavity and a paint can rim assembly; the paint can rim assembly including a circumferential lid/first sealing ring ridge receiving channel defined therein of a first channel bottom width and a circumferential inner rim edge that defines a circular top opening in connection with the paint holding cavity; the lid having a circumferential lid edge, a circumferential lid ridge, a circumferential first sealing ring ridge receiving channel, a circumferential inner rim edge receiving channel, and a circular central lid portion; the circumferential lid ridge being formed adjacent to the circumferential lid edge and of a first ridge tip width; the circumferential first sealing ring ridge receiving channel being formed in alignment with the circumferential lid ridge and of a second channel bottom width; the circumferential inner rim edge receiving channel being in opposite orientation to the first sealing ring ridge receiving channel and of a third channel bottom width; the sealing ring being molded of a resilient material and including a circumferential outer edge portion, a circumferential lid edge receiving channel formed into the outer edge portion, a circumferential first sealing ring ridge partially defining the lid edge receiving channel and having a second ridge tip width, a circumferential second sealing ring ridge oriented oppositely away from the first sealing ring ridge and having a third ridge tip width, a brush wiping flange integrally formed with the first and the second ring sealing ridges and having an outer flange edge; and a central sealing ring opening defined by the outer flange edge of the brush wiping flange; the first channel bottom width, the first ridge tip width, and the third ridge tip width being equal; the second channel bottom width and the second ridge tip width being equal; the lid edge receiving channel being sized to receive the lid edge therein when the circumferential first sealing ring ridge is inserted into the circumferential first sealing ring ridge receiving channel.

It is a still further object of the invention to provide a paint can system that accomplishes some or all of the above objects in combination.

Accordingly, a paint can system is provided. The paint can system includes a paint can having a paint can rim assembly to which a user can affix a lid or a resilient sealing ring having a brush wiping flange defining a central sealing ring opening through which a paint brush can be loaded; the paint can including a cylinder shaped paint holding cavity and a paint can rim assembly; the paint can rim assembly including a circumferential lid/first sealing ring ridge receiving channel defined therein of a first channel bottom width and a circumferential inner rim edge that defines a circular top opening in connection with the paint holding cavity; the lid having a circumferential lid edge, a circumferential lid ridge, a circumferential first sealing ring ridge receiving channel, a circumferential inner rim edge receiving channel, and a circular central lid portion; the circumferential lid ridge being formed adjacent to the circumferential lid edge and of a first ridge tip width; the circumferential first sealing ring ridge receiving channel being formed in alignment with the circumferential lid ridge and of a second channel bottom width; the circumferential inner rim edge receiving channel being in opposite orientation to the first sealing ring ridge receiving channel and of a third channel bottom width; the sealing ring being molded of a resilient material and including a circumferential outer edge portion, a circumferential lid edge receiving channel formed into the outer edge portion, a circumferential first sealing ring ridge partially defining the lid edge receiving channel and having a second ridge tip width, a circumferential second sealing ring ridge oriented oppositely away from the first sealing ring ridge and having a third ridge tip width, a brush wiping flange integrally formed with the first and the second ring sealing ridges and having an outer flange edge; and a central sealing ring opening defined by the outer flange edge of the brush wiping flange; the first channel bottom width, the first ridge tip width, and the third ridge tip width being equal; the second channel bottom width and the second ridge tip width being equal; the lid edge receiving channel being sized to receive the lid edge therein when the circumferential first sealing ring ridge is inserted into the circumferential first sealing ring ridge receiving channel.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
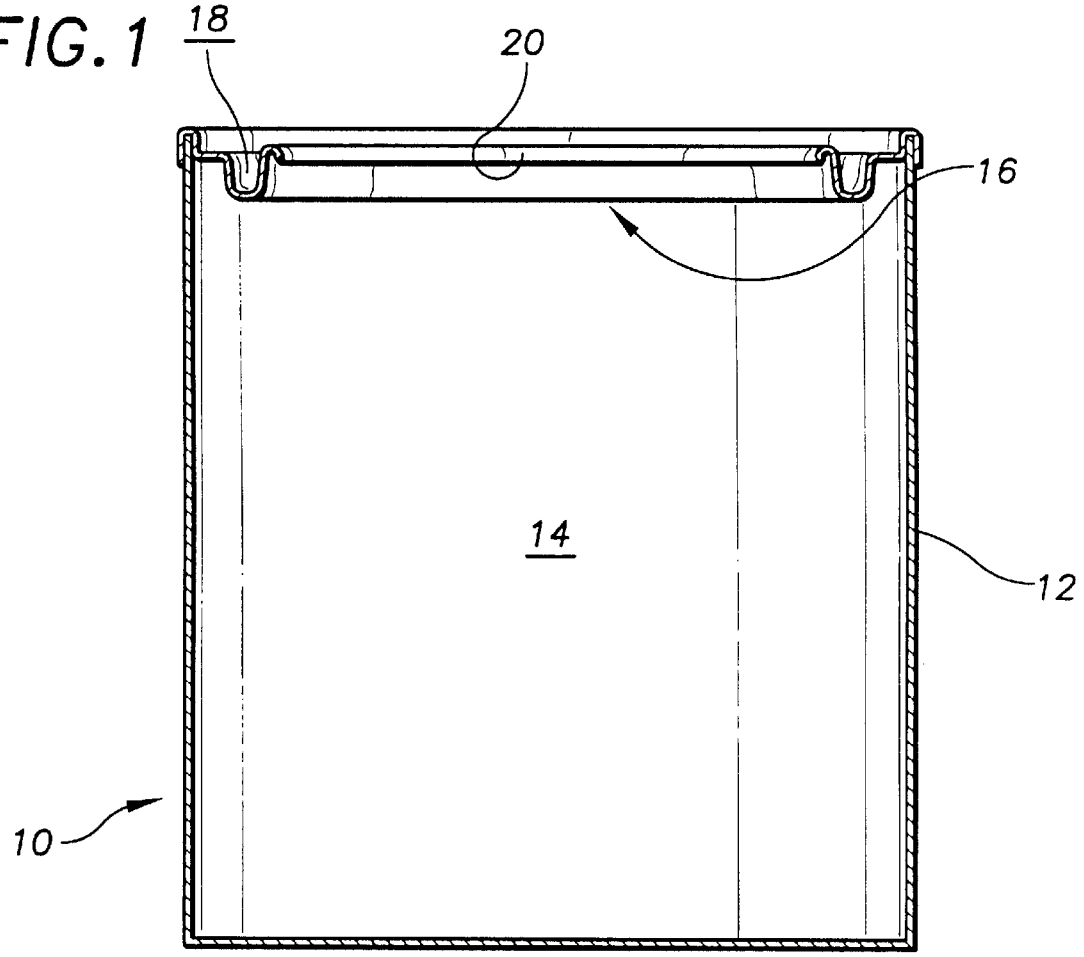
FIG. 1 is a center cross section view of an exemplary embodiment of the paint can of the paint can system of the present invention showing the cylinder shaped paint holding cavity and the paint can rim assembly including the circumferential lid/first sealing ring ridge receiving channel having a first channel bottom width and the circumferential inner rim edge defining the circular top opening.
Figure 4:
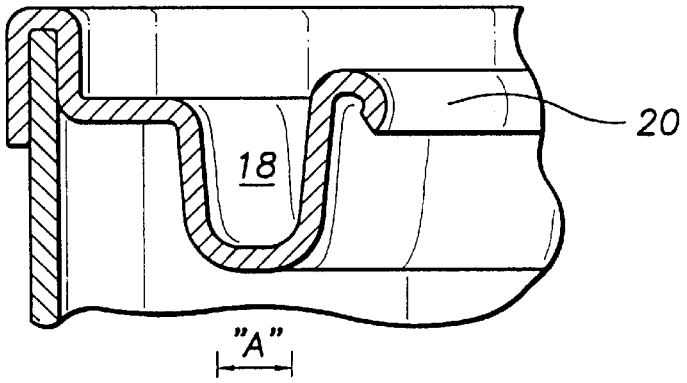
FIG. 4 is a detail cross section view of the paint can rim assembly of FIG. 1 showing the circumferential lid/first sealing ring ridge receiving channel with the first channel bottom width, and the circumferential inner rim edge defining the circular top opening.

FIG. 1 shows a center cross section through an exemplary embodiment of the paint can of the paint can system of the present invention generally designated by the numeral 10. Paint can 10 includes a metal container structure 12 having a cylinder shaped paint holding cavity 14 formed therein and a paint can rim assembly, generally designated 16, permanently affixed to container structure 12. Paint can rim assembly 14 includes a circumferential lid/first sealing ring ridge receiving channel 18, referring to FIG. 4, having a first channel bottom width "A" and a circumferential inner rim edge 20 defining, with reference now to FIG. 1A, a circular top opening 22. A number of rectangular paint drain apertures 24 are formed through paint can rim assembly 16 at the bottom of circumferential lid/first sealing ring ridge receiving channel 18.

Figure 2:
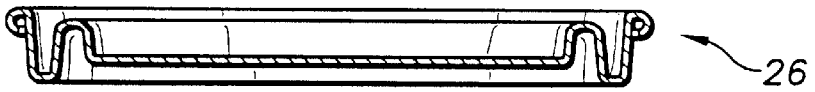
FIG. 2 is a center cross section view of an exemplary embodiment of the lid of the paint can system of the present invention showing the circumferential lid edge, the circumferential lid ridge having a first ridge tip width, the circumferential first sealing ring ridge receiving channel in alignment with the circumferential lid ridge and having a second channel bottom width, the circumferential inner rim edge receiving channel in opposite orientation to the first sealing ring ridge receiving channel and having a third channel bottom width, and the circular central lid portion.
Figure 2A:
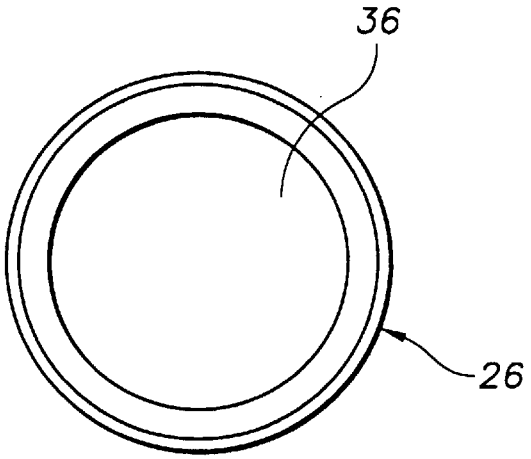
FIG. 2A is a top plan view of the exemplary lid of FIG. 2 showing the circumferential lid edge, the circumferential first sealing ring ridge receiving channel, and the circular central lid portion.
Figure 5:
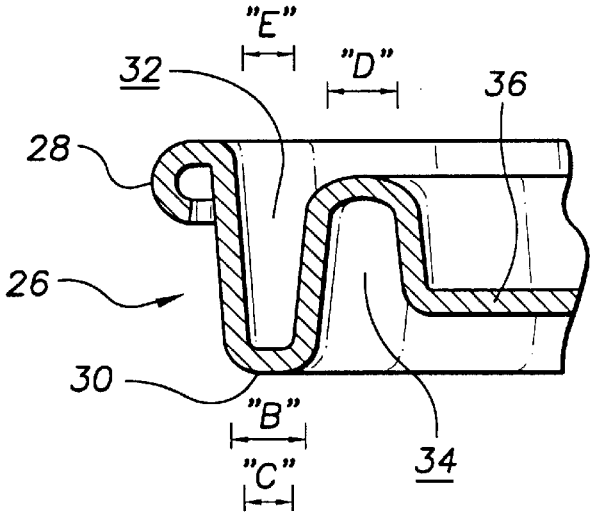
FIG. 5 is a detail cross section view of the lid of the paint can system of the present invention showing the circumferential lid edge, the circumferential lid ridge having a first ridge tip width, the circumferential first sealing ring ridge receiving channel having a second channel bottom width, the circumferential inner rim edge receiving channel having a third channel bottom width, and the circular central lid portion.

FIG. 2 is a center cross section view of an exemplary embodiment of the lid of the paint can system of the present invention generally designated by the numeral 26. Lid 26 is of stamped metal construction and, referring to FIG. 5, includes a circumferential lid edge 28, a circumferential lid ridge 30 having a first ridge tip width "B", a circumferential first sealing ring ridge receiving channel 32 in alignment with circumferential lid ridge 30 and having a second channel bottom width "C", a circumferential inner rim edge receiving channel 34 in opposite orientation to first sealing ring ridge receiving channel 32 and having a third channel bottom width "D", and a circular central lid portion 36 (see also FIG. 2A).

Figure 3:
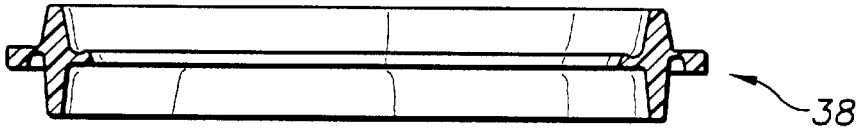
FIG. 3 is a center cross section view of an exemplary embodiment of the sealing ring of the paint can system of the present invention showing the circumferential outer edge portion, the circumferential lid edge receiving channel formed into the outer edge portion, the circumferential first sealing ring ridge partially defining the lid edge receiving channel and having a second ridge tip width, the circumferential second sealing ring ridge oriented oppositely away from the first sealing ring ridge and having a third ridge tip width, the disk shaped brush wiping flange integrally formed with the first and the second ring sealing ridges, and the central sealing ring opening.
Figure 3A:
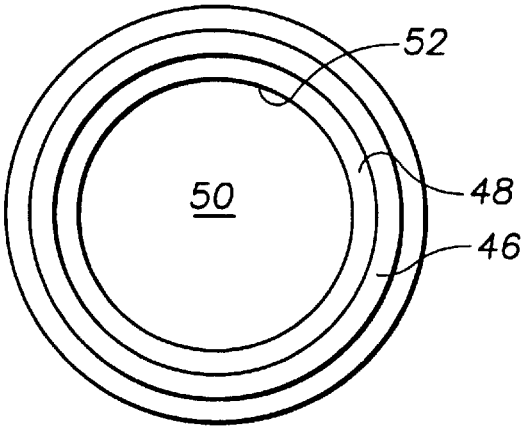
FIG. 3A is a top plan view of the exemplary embodiment of the sealing ring of FIG. 3 showing the circumferential outer edge portion, the circumferential second sealing ring ridge, the disk shaped brush wiping flange and the central sealing ring opening.
Figure 6:
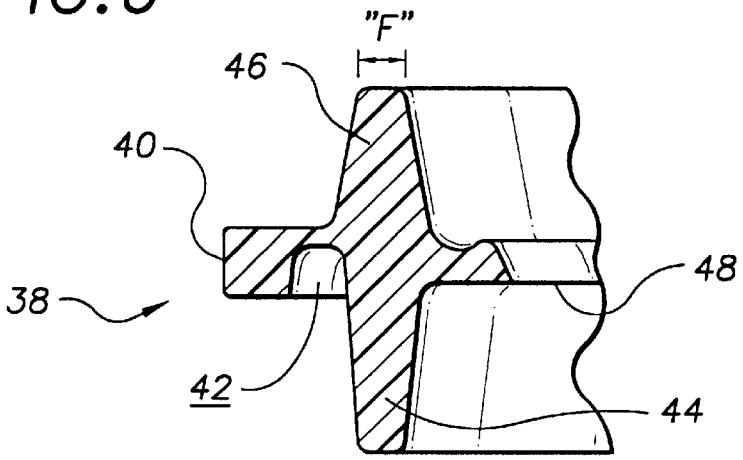
FIG. 6 is a detail cross section view of the sealing ring of FIG. 2 showing the circumferential outer edge portion, the circumferential lid edge receiving channel formed into the outer edge portion, the circumferential first sealing ring ridge having a second ridge tip width, the circumferential second sealing ring ridge having a third ridge tip width, the brush wiping flange, and the central sealing ring opening.

FIG. 3 is a center cross section view of an exemplary embodiment of the sealing ring of the paint can system of the present invention generally designated by the numeral 38. Sealing ring 38 is molded of resilient plastic an includes, referring now to FIG. 6, a circumferential outer edge portion 40, a circumferential lid edge receiving channel 42 formed into outer edge portion 40, a circumferential first sealing ring ridge 44 that partially defines lid edge receiving channel 42 and that has a second ridge tip width "E", a circumferential second sealing ring ridge 46 oriented oppositely away from first sealing ring ridge 44 and having a third ridge tip width "F", and referring to FIG. 3A, a disk shaped brush wiping flange 48 integrally formed with the first and the second ring sealing ridges 44,46 (sealing ridge 44 shown in FIG. 6) and a circular central sealing ring opening 50 defined by an outer flange edge 52 of brush wiping flange 48. With general reference to FIGS. 4–6, first channel bottom width "A", first ridge tip width "B" and third ridge tip width "F" are equal; second channel bottom width "C" and second ridge tip width "E" are equal; and lid edge receiving channel 42 is sized to receive lid edge 28 therein when circumferential first sealing ring ridge 44 is inserted into circumferential first sealing ring ridge receiving channel 32.

Figure 1A:
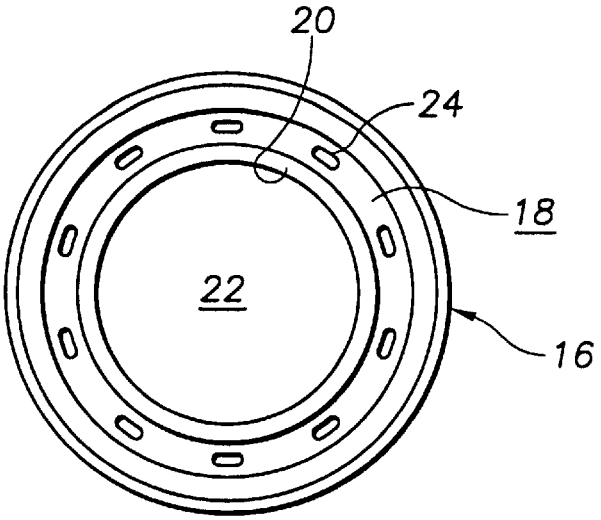
FIG. 1A is a top plan view of the exemplary paint can of FIG. 1 showing the top opening in connection with the paint holding cavity and the paint can rim assembly including the circumferential lid/first sealing ring ridge receiving channel with the rectangular paint drain apertures, and the circumferential inner rim edge defining the top opening.
Figure 7:
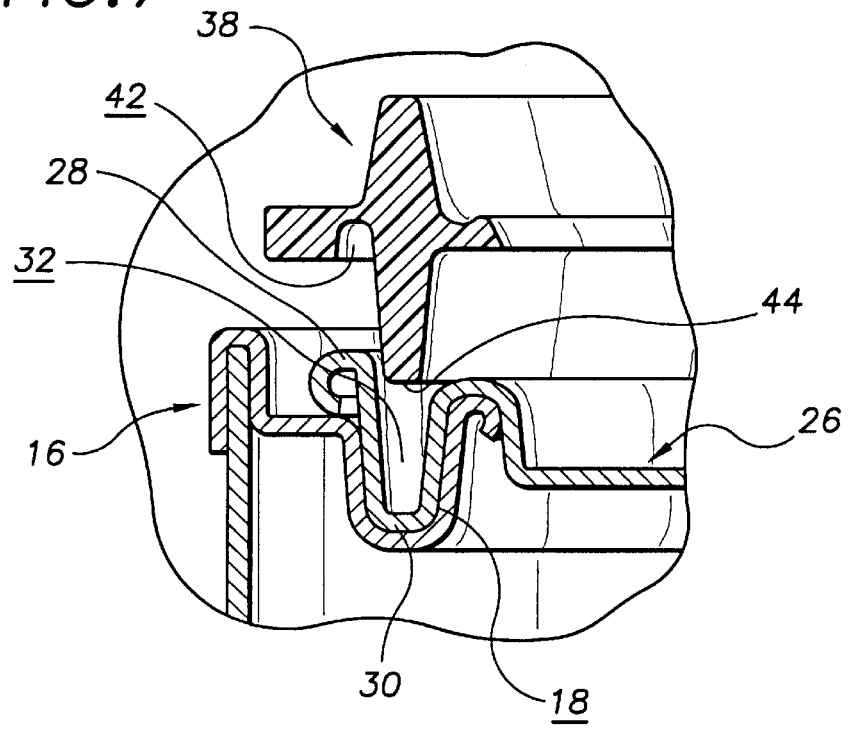
FIG. 7 is a detail cross section view showing the circumferential lid ridge inserted and frictionally held within the circumferential lid/first sealing ring ridge receiving channel of the paint can rim assembly; the circumferential inner rim of the paint can rim assembly positioned within the circumferential inner rim edge receiving channel of the lid; the circumferential lid edge positioned beneath the circumferential lid edge receiving channel formed into the outer edge portion of the sealing ring; and the circumferential first sealing ring ridge partially inserted into the circumferential first sealing ring ridge receiving channel of the lid.

With reference to FIG. 7, during shipping and long term storage of the paint can system, lid 26 is secured to rim assembly 16 by force fitting circumferential lid ridge 30 into circumferential lid/first sealing ring ridge receiving channel 18 to seal circular top opening 22 (FIG. 1A). In this sealed configuration, sealing ring 38 is attached to lid 26 for storage by inserting circumferential first sealing ring ridge 44 into circumferential first sealing ring ridge receiving channel 32 a distance sufficient to seat circumferential lid edge 28 within lid edge receiving channel 42.

Figure 8:
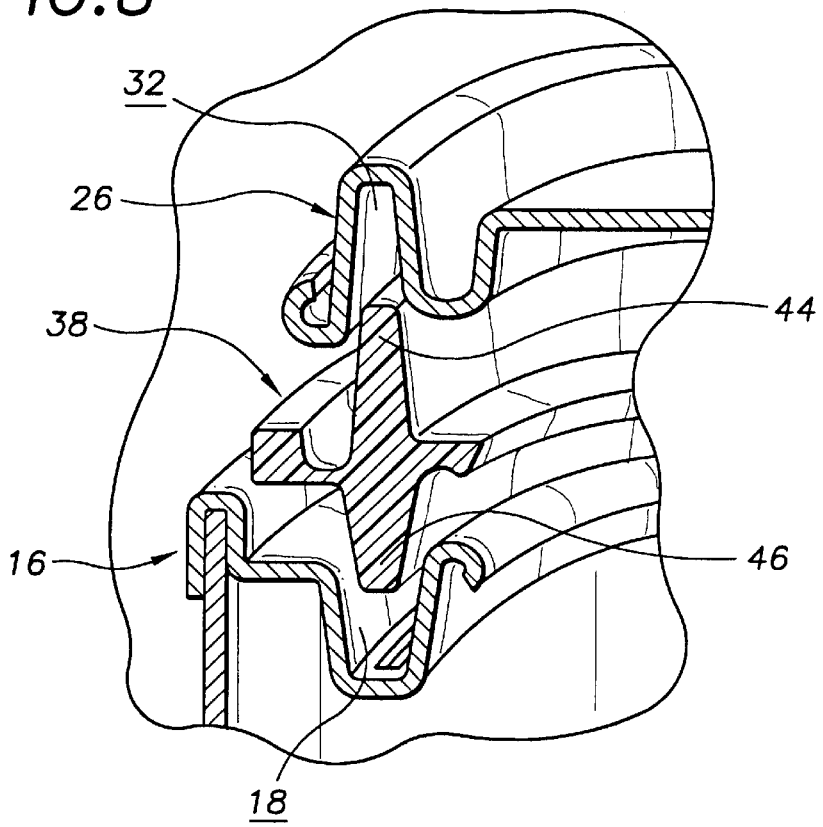
FIG. 8 is a detail cross section view showing the circumferential second sealing ring ridge positioned above the circumferential lid/first sealing ring ridge receiving channel of the paint can rim assembly; the circumferential lid edge positioned above the circumferential lid edge receiving channel formed into the outer edge portion of the sealing ring; and the circumferential first sealing ring ridge positioned beneath and partially inserted into the circumferential first sealing ring ridge receiving channel of the lid.

When it is desired to use the stored paint, lid 26 is pried free from rim assembly 16 and, referring now to FIG. 8, sealing ring 38 installed in connection with rim assembly 16 by inserting second sealing ring ridge 46 into circumferential lid/first sealing ring ridge receiving channel 18 to prevent the accumulation of paint within lid/first sealing ring ridge receiving channel 18. Should a user desire to seal the paint can for a short period, such as a lunch or coffee break, lid 26 can be inverted and installed over sealing ring 38 by positioning circumferential first sealing ring ridge receiving channel 32 of lid member 26 over circumferential first sealing ring ridge 44 and pressing down firmly.

It can be seen from the preceding description that a paint can system has been provided that includes a sealing ring having a sealing ridge that is insertable into the lid ridge receiving channel of a paint can rim assembly; that includes a sealing ring having a brush wiping flange that had an outer flange edge that defines an opening through which the paint brush can be loaded with paint when the sealing flange is installed; that includes a sealing ring adapted such that the lid of the paint can is seatable, in an upside down orientation, onto the sealing ring to cover the opening through the sealing ring to seal the paint can; and that includes a paint can having a paint can rim assembly to which a user can affix a lid or a resilient sealing ring having a brush wiping flange defining a central sealing ring opening through which a paint brush can be loaded; the paint can including a cylinder shaped paint holding cavity and a paint can rim assembly; the paint can rim assembly including a circumferential lid/first sealing ring ridge receiving channel defined therein of a first channel bottom width and a circumferential inner rim edge that defines a circular top opening in connection with the paint holding cavity; the lid having a circumferential lid edge, a circumferential lid ridge, a circumferential first sealing ring ridge receiving channel, a circumferential inner rim edge receiving channel, and a circular central lid portion; the circumferential lid ridge being formed adjacent to the circumferential lid edge and of a first ridge tip width; the circumferential first sealing ring ridge receiving channel being formed in alignment with the circumferential lid ridge and of a second channel bottom width; the circumferential inner rim edge receiving channel being in opposite orientation to the first sealing ring ridge receiving channel and of a third channel bottom width; the sealing ring being molded of a resilient material and including a circumferential outer edge portion, a circumferential lid edge receiving channel formed into the outer edge portion, a circumferential first sealing ring ridge partially defining the lid edge receiving channel and having a second ridge tip width, a circumferential second sealing ring ridge oriented oppositely away from the first sealing ring ridge and having a third ridge tip width, a brush wiping flange integrally formed with the first and the second ring sealing ridges and having an outer flange edge; and a central sealing ring opening defined by the outer flange edge of the brush wiping flange; the first channel bottom width, the first ridge tip width, and the third ridge tip width being equal; the second channel bottom width and the second ridge tip width being equal; the lid edge receiving channel being sized to receive the lid edge therein when the circumferential first sealing ring ridge is inserted into the circumferential first sealing ring ridge receiving channel.

It is noted that the embodiment of the paint can system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A paint can system comprising:

a paint can having a paint can rim assembly including a circumferential lid/first sealing ring ridge receiving channel defined therein of a first channel bottom width and a circumferential inner rim edge that defines a circular top opening in connection with said paint holding cavity;

a lid having a circumferential lid edge, a circumferential lid ridge, a circumferential first sealing ring ridge receiving channel, a circumferential inner rim edge receiving channel, and a circular central lid portion, said circumferential lid ridge being formed adjacent to said circumferential lid edge and of a first ridge tip width, said circumferential first sealing ring ridge receiving channel being formed in alignment with said circumferential lid ridge and of a second channel bottom width, said circumferential inner rim edge receiving channel being in opposite orientation to said first sealing ring ridge receiving channel and of a third channel bottom width;

said sealing ring being molded of a resilient material and including a circumferential outer edge portion, a circumferential lid edge receiving channel formed into said outer edge portion, a circumferential first sealing ring ridge partially defining said lid edge receiving channel and being of a second ridge tip width, a circumferential second sealing ring ridge oriented oppositely away from said first sealing ring ridge and being of a third ridge tip width, a brush wiping flange integrally formed with said first and said second ring sealing ridges and having an outer flange edge, and a central sealing ring opening defined by said outer flange edge of said brush wiping flange;

said first channel bottom width, said first ridge tip width, and said third ridge tip width being equal;

said second channel bottom width and said second ridge tip width being equal;

said lid edge receiving channel being sized to receive said lid edge therein when said circumferential first sealing ring ridge is inserted into said circumferential first sealing ring ridge receiving channel.

* * * * *